United States Patent [19]

Yamashita et al.

[11] 4,275,879

[45] Jun. 30, 1981

[54] ABNORMAL FEED CONDITION-DETECTING APPARATUS FOR A PRINTING DEVICE

[75] Inventors: Mitsuo Yamashita, Tokyo; Osamu Kondo, Kawasaki, both of Japan

[73] Assignee: Tokyo Shibaura Denki Kabushiki Kaisha, Kawasaki, Japan

[21] Appl. No.: 81,556

[22] Filed: Oct. 3, 1979

[51] Int. Cl.[3] ..... B65H 43/08; B65H 43/02

[52] U.S. Cl. ..... 271/259; 340/674; 355/14 R

[58] Field of Search ..... 271/259, 258; 340/674, 340/675; 355/14 R

[56] References Cited

U.S. PATENT DOCUMENTS

| | | | |
|---|---|---|---|
| 3,114,902 | 12/1963 | Tanguy | 340/674 |
| 3,693,969 | 9/1972 | Sakamaki et al. | 271/258 |
| 3,833,896 | 9/1974 | Suzuki | 271/258 X |
| 3,970,384 | 7/1976 | Yamamoto et al. | 271/259X |
| 3,999,851 | 12/1976 | Sakamaki et al. | 271/259 X |
| 4,026,543 | 5/1977 | Leclere | 271/259 |

FOREIGN PATENT DOCUMENTS

| | | |
|---|---|---|
| 53-40093 | 10/1978 | Japan . |
| 53-41532 | 11/1978 | Japan . |

OTHER PUBLICATIONS

Cutaia, A. et al., "Jam Detection System", *IBM Technical Disclosure Bulletin,* vol. 5, No. 5, Oct. 1962, pp. 28, 29.

*Primary Examiner*—Bruce H. Stoner, Jr.

*Attorney, Agent, or Firm*—Cushman, Darby & Cushman

[57] ABSTRACT

An abnormal feed condition-detecting apparatus for a printing device in which sheets are delivered one by one from a feeder to the printing section at the prescribed time interval, the detecting apparatus comprising a first paper passage detector disposed near the fender and a second paper passage detector positioned near the outlet port of the printing device and being designed to detect the passage of the respective succeeding sheets on the prescribed length of time, and, in the occurrence of an abnormal feed condition, sending forth an abnormality signal only after all the sheets delivered from the feeder before the detection of the abnormal feed condition have been drawn out of the printing device.

4 Claims, 7 Drawing Figures

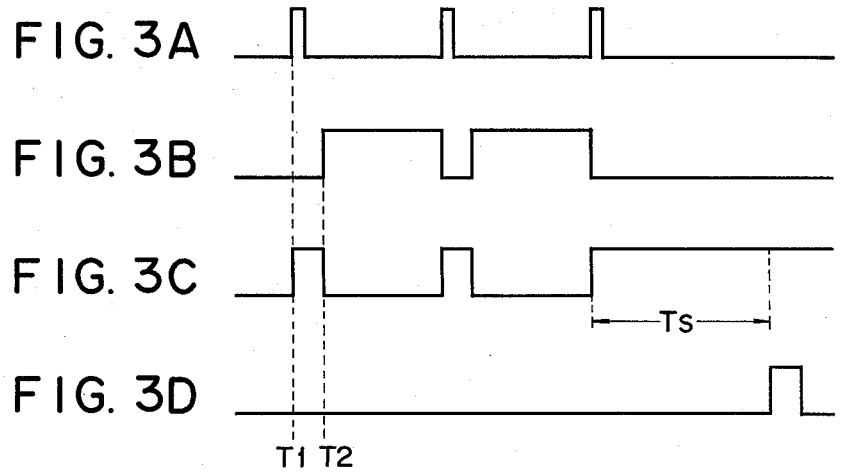
FIG. 4
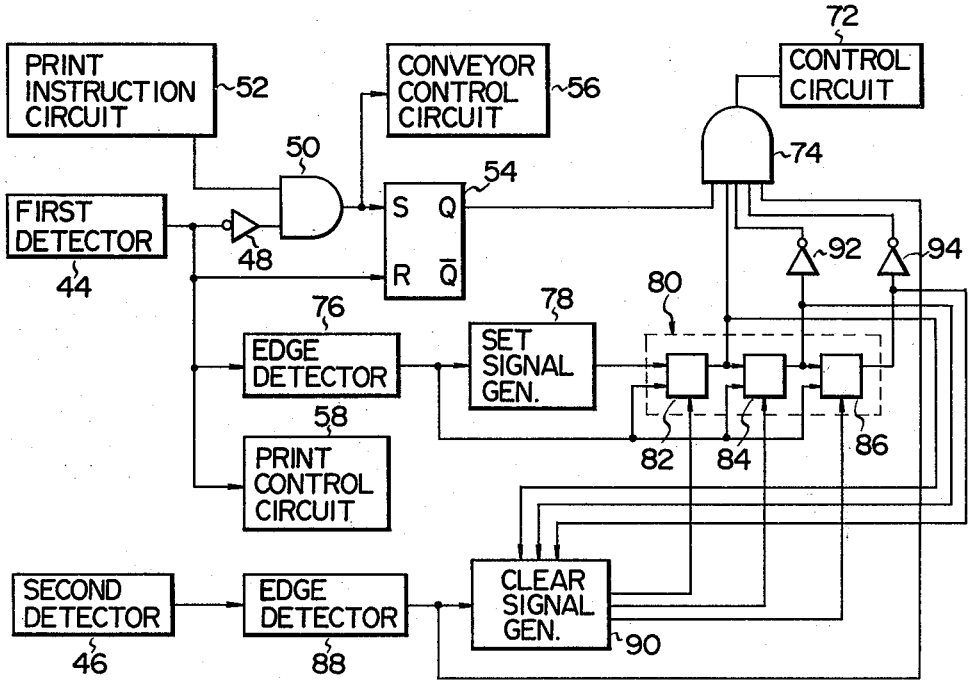

ABNORMAL FEED CONDITION-DETECTING APPARATUS FOR A PRINTING DEVICE

BACKGROUND OF THE INVENTION

This invention relates to an apparatus for detecting an abnormal feed condition such as the failure of paper feed occurring in, for example, a printer or copying machine.

In recent years, various types of electronic printing devices are put to practical use, in which sheets are taken out of a feeder one by one; data is impressed on a sensitized drum by means of an optical fiber tube; the impressed data is electrostatically transcribed on the sheet; and a sheet on which data is visibly printed is drawn out through the outlet port of the printing device. With the above-mentioned type of printing device, data is printed on the sheets while they are traveling through the printing device one after another, after having been taken out of the feeder at the prescribed time interval. Unless, therefore, the sheets are transported exactly at the prescribed time interval, the position of data printed on a sheet tends to be displaced; and if a sheet is not yet set in the print position, data alone is sometimes supplied and consequently wasted. Such a defective feed condition is mainly caused by the idle running of a feed roller which is designed to frictionally send copy sheets one by one from the feeder to, for example, a conveyor belt.

With the conventional printer and copying machine, a point of time at which a sheet is delivered from the feeder is defined by, for example, a timer. Where a sheet is not drawn out within the prescribed length of time, then this event is regarded as abnormal, and the printing device is stopped. If, in this case, the printing device is stopped as soon as the above-mentioned abnormal condition is detected, then a sheet which is being carried through the printing device is left therein. This retained paper has to be manually removed by opening the printing device. In this case, data impressed on the retained paper often still remains unfixed and consequently is wasted. Where the printing device is again put into operation, the unfixed data has to be supplied again to the printing device, complicating the control process. Further, the above-mentioned manual removal of the retained paper tends to give rise to errors in the subsequent setting of the printing device, probably leading to the occurrence of a fresh case of the failure of proper paper feed. Therefore, it may be considered advisable to attempt to stop the printing device after all the sheets carried by a conveyor belt have been drawn out of the printing device, instead of at the moment when the abnormal feed condition is detected. However, such an attempt would make it necessary to provide a separate timer or detection means and intricate control means, eventually complicating the arrangement of the printing device with the resultant cost increase.

SUMMARY OF THE INVENTION

For a printing device in which sheets are delivered one by one from a feeder, and data is printed on the sheets while they are carried through the printing device by, for example, a conveyor belt, and the printed sheet is finally drawn out through the outlet port, this invention provides an apparatus which can detect the occurrence of an abnormal paper feed condition during the delivery of sheets from the feeder without the undesired retainment of sheets in the printing device as has often been the case with the prior art printing device, thereby preventing any sheet carried by the conveyor belt from being drawn out of the printing device with printed data left unfixed.

To attain the above-mentioned object, this invention provides an abnormal feed condition-detecting apparatus for a printing device which comprises:

a conveyor belt for transporting sheets delivered one by one from the feeder to the outlet port at the prescribed time interval;

first and second paper passage detectors respectively disposed at the starting and terminal points of the conveyor belt; and an arithmetic operation unit designed to arithmetically compute the contents of output signals from the first and second paper passage detectors, and, where a time interval between any two adjacent paper passage detections by the first paper passage detector is found to be longer than the prescribed length of time, and the second paper passage detector has detected the withdrawal from the printing device of a sheet carried by the conveyor belt immediately before the detection of the above-mentioned unusually long time interval, to generate a signal denoting the occurrence of an abnormal condition.

BRIEF DESCRIPTION OF THE DRAWINGS

FIGS. 3A to 3D are timing charts showing the operation of said embodiment; and FIG. 4 is a block circuit diagram of an abnormal feed condition-detecting apparatus according to another embodiment of the invention for a printing device.

DETAILED DESCRIPTION OF THE INVENTION

Figure 1:
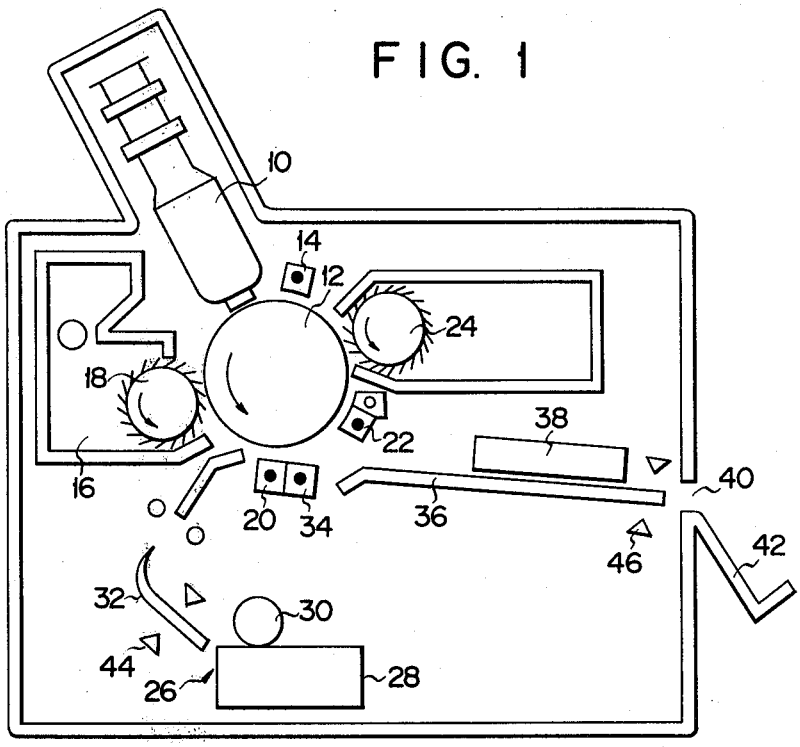
FIG. 1 shows the arrangement of an electronic printer provided with an abnormal feed condition-detecting apparatus embodying this invention.

FIG. 1 shows the arrangement of an electronic printing device provided with an abnormal feed condition-detecting apparatus embodying this invention. An optical fiber tube (hereinafter referred to as "OFT") 10 which sends forth an optical image in accordance with the contents of a data signal delivered from the later described print control circuit (FIG. 2) is so set as to face a sensitized drum 12. The sensitized drum 12 is formed of a photoelectric material such as selenium. An optical image projected from the OFT 10 creates an electrostatic latent image on the surface of the sensitized drum 12. The sensitized drum 12 is rotated in the direction of an arrow indicated in FIG. 1. The surface of the sensitized drum 12 is electrically charged by a charging unit 14. An electrostatic latent image is formed on the surface of the sensitized drum 12 by the OFT 10. The electrostatic latent image is changed into a visible form, when a developing powder is applied on the latent image by the brush 18 of a developing unit 16. As a result, data corresponding to a signal delivered from the print control circuit (FIG. 2) is visibly indicated on the surface of the sensitized drum 12. A developing powder deposited on the visible image or electrostatic latent image is attracted to a sheet (not shown) which is electrically charged by a transcription charging unit 20, thereby effecting the transcription of the visible image to the sheet. After transcription, the sensitized drum 12 is reversely charged by a discharging unit 22 to eliminate the remnant of the previously produced electric charge. At this time, a developing powder still remaining on the surface of the sensitized drum 12 is removed by a cleaner 24.

Sheets are supplied one by one from the feeder 26 with the rotation of the sensitized drum 12. The feeder 26 includes a cassette 28 holding a large number of sheets and a feed roller 30 for frictionally taking sheets one by one out of the cassette 28 at the prescribed time interval. A sheet drawn out by the feed roller 30 is carried by a first conveyor belt 32 to the transcription charging unit 20, where a visible image on the surface of the sensitized drum 12 is transcribed on the paper. A sheet on which a visible image has been transcribed is supplied with A.C. charge by a charging unit 34 to be removed from the sensitized drum 12, and then carried by a second conveyor belt 36 into a fixing unit 38. The sheet whose printed impression has been thermally fixed is taken out of the printing device through an outlet port 40 to be guided to a stacker 42.

A first paper passage detector 44 formed of, for example, light-emitting and light-receiving elements, is set at the starting point of the first belt conveyor 32, to detect the delivery of a sheet from the feeder 26. A second paper passage detector 46, similarly formed of light-emitting and light-receiving elements is disposed at the terminal point of the second belt conveyor 36, that is, near the outlet port 40 to detect the passage through the outlet port 40 of a sheet which has been taken out of the fixing unit 38.

With the foregoing embodiment, the feeder 26 is supposed to include the cassette 28 holding a large number of cut sheets. However, the feeder 26 may be of the type where a roll of continuous paper is cut up into individual sheets by a cutter when the paper is supplied to the printing device.

Figure 2:
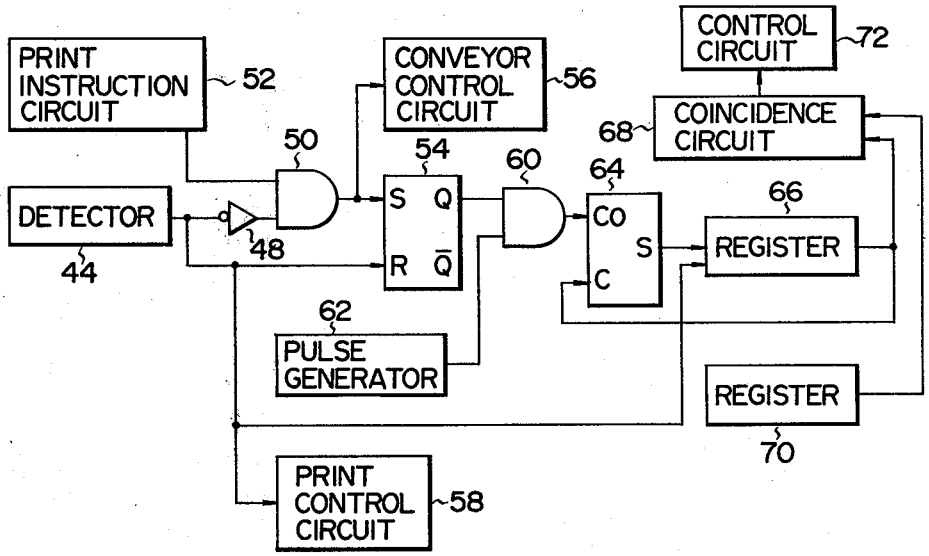
FIG. 2 is a block circuit diagram of an abnormal feed condition-detecting apparatus according to one embodiment of the invention for a printing device.

FIG. 2 is a block circuit diagram showing the electric arrangement of an abnormal feed condition-detecting apparatus according to one embodiment of this invention for a printing device. The output terminal of the first paper passage detector 44 is connected to one of the input terminals of an AND gate 50 through an inverter 48. A print instruction issued from a print instruction circuit 52 including, for example, an I/O device and start button is delivered to the other input terminal of the AND gate 50. The output terminal of the AND gate 50 is connected to the set terminal S of a flip-flop circuit 54. The output terminal of the first paper passage detector 44 is connected to the reset terminal R of the flip-flop circuit 54. The output terminal of the AND gate 50 is also connected to a conveyor belt control circuit 56. The output terminal of the first paper passage detector 44 is also connected to a print control circuit 58. The conveyor belt control circuit 56 controls the operation of the sensitized drum 12, feed roller 30 and first and second conveyor belts 32, 36. The print control circuit 58 controls the operation of the OFT 10. The set output terminal Q of the flip-flop circuit 54 is connected to one of the input terminals of an AND gate 60. The output terminal of a pulse generator 62 which issues clock pulses having the prescribed frequency for measurement of time is connected to the other input terminal of the AND gate 60. An output pulse from the AND gate 60 is supplied to one of the input terminals of an adder 64. An output signal from the adder 64 is supplied to a register 66, an output signal from which is conducted to the other input terminal of the adder 64. Each time a pulse is supplied from the AND gate 60 to the adder 64, the adder 64 adds a number "1" to the contents of the register 66. The result of the addition is stored in said register 66. The contents of the register 66 is cleared by an output signal from the first paper passage detector 44. An output signal from the register 66 is conducted to one of the input terminals of a coincidence circuit 68 to be compared with the contents or referential time data of a register 70 connected to the other input terminal of the coincidence circuit 68 and designed to store a referential time data. The register 70 stores in the form of a numerical value a length of time required for a sheet to be carried by the first and second conveyor belt 32, 36 from the first paper passage detector 44 to the discharge port 40, or more exactly, a length of time required for a sheet to be conducted from the first paper passage detector 44 to the second paper passage detector 46. The above-mentioned length of time is hereinafter referred to as "a referential period TS". Where coincidence takes place between the contents of the register 66 and those of the register 70, then the coincidence circuit 68 issues a coincidence signal denoting the occurrence of an abnormal paper feed condition. A signal denoting an abnormal paper feed condition (hereinafter referred to as "an abnormality signal") is carried to an abnormality control circuit 72. When receiving an abnormality signal from the coincidence circuit 68, the abnormality control circuit 72 causes an abnormal paper feed condition to be displayed and informs the operator of said event.

There will now be described by reference to the timing charts of FIGS. 3A and 3D the operation of an abnormal feed condition-detecting apparatus embodying this invention for a printing device, which is constructed as mentioned above. Now let it be assumed that a printing device is going to print a plurality of sheets in succession. In this case, the print instruction circuit 52 successively issues print instructions having a logic level of "1" (FIG. 3A) to the OFT 10 at the prescribed time interval. A print instruction for a first sheet is supplied to the AND gate 50 at a point of time T1. Since, at this time, the conveyor belt control circuit 56 is not yet put into operation, no sheet is delivered from the feeder 26. The first paper passage detector 44 does not detect the passage of any sheet. Therefore, a detection signal issued from the first detector 44 has a logic level of "0" (FIG. 3B). Accordingly, an output signal from the inverter 48 has a logic level of "1", and the AND gate 50 is opened. The flip-flop circuit 54 is set (FIG. 3C), and the belt conveyor control circuit 56 is energized. When this control circuit 56 is actuated, the sensitized drum 12, feed roller 30 and first and second conveyor belts 32, 36 are driven. A sheet is drawn out of the cassette 28 by the action of the feed roller 30. When the flip-flop circuit 54 is set, a set output signal is delivered to the AND gate 60. As a result, a pulse issued from the pulse generator 62 is conducted to the adder 64 through the AND gate 60. Each time a pulse is supplied, the adder 64 successively adds a number "1" to the contents of the register 66. The result of the addition is again stored in the register 66. Thus, the contents of the register 66 which is initially cleared to "0", are progressively increased by 1 as "1", "2", "3".... The contents of the register 66 are supplied to the coincidence circuit 68.

A sheet drawn out of the cassette 28 by the feed roller 30 is delivered to the first conveyor belt 32. The first detector 44 which has detected the passage of the sheet produces an output signal having a logic level of "1" (FIG. 3B), at a point of time T2. As a result, the inverter 48 generates an output signal having a logic level of "0", the AND gate 50 is disabled, and the flip-flop circuit 54 is reset (FIG. 3C). Since the AND gate 60 is disabled when the flip-flop circuit 54 is reset, a pulse is not supplied to the adder 64, whose output isn't increased. An output signal from the first paper passage detector 44 which has a logic level of "1" resets the register 66. Thus the adder 64 and register 66 cooperate to measure a period extending from a point of time at which a sheet is taken out of the feed section 26 by the action of the feed roller 30 to a point of time at which the passage of the sheet is detected by the first detector 44. When the first detector 44 generates an output signal having a logic level of "1", the print control circuit 58 is energized to supply a data signal to the OFT 10. An electrostatic latent image corresponding to the data signal is formed on the surface of the sensitized drum 12. When developed by the developing unit 16, the electrostatic latent image formed on the surface of the sensitized drum 12 is changed into a visible form. The visible image is transcribed on a sheet carried to the sensitized drum 12 at the time of the development. The sheet on which the visible image has been transcribed is conducted by the second conveyor belt 36 to the fixing unit 38, where the visible image printed on the sheet is fixed. The sheet whose printed image has been fixed is drawn out through the outlet port 40 to the stacker 42. The above-mentioned operation is repeated, each time a print instruction is issued, thus effecting continuous printing.

During the continuous printing operation, however, abnormal conditions sometimes happen, in which the cassette 28 is not supplied with any sheet, though the feed roller 30 is operated in response to a print instruction; a sheet is not properly drawn out of the cassette 28 by the feed roller; or jamming occurs between the feed roller 30 and first paper passage detector 44. Under any of the above-mentioned abnormal conditions, a sheet fails to be supplied, and consequently the first detector 44 obviously does not detect the passage of a sheet. Consequently the flip-flop circuit 54 is kept in a set state (FIG. 3C). The adder 64 continues counting, and the contents of the register 66 are not cleared. Therefore, upon lapse of the referential period TS, the contents of the register 66 coincide with those of the register 70. Consequently, the coincidence circuit 68 issues an abnormality signal (FIG. 3D). The abnormality control circuit 72 notifies the operator of the occurrence of an abnormal feed condition.

The referential period TS stored in the register 70 is chosen to denote a length of time required for a sheet to be carried from the first paper passage detector 44 to the second paper passage detector 46. Where, therefore, an abnormal condition arises, the printing device is not stopped immediately. According to this invention, the occurrence of an abnormal condition is not determined, until all sheets on which a visible image has already been transcribed and yet which are still being carried by a conveyor belt have been drawn out of a printing device. Upon the occurrence of an abnormal feed condition, therefore this invention causes the operation of a printing device to be stopped, only after all sheets retained in the printing device are drawn out. Consequently, the data transcribed on a sheet taken out of the feeder before the judgement of the occurrence of an abnormal condition is prevented from being wasted. In other words, any sheet traveling through the printing device is not drawn out therefrom, while the data printed on said sheet still remains unfixed. The abnormal feed condition-detecting apparatus of this invention for a printing device is not restricted to the type of the aforesaid embodiment. There will now be described by reference to the block circuit diagram of FIG. 4 an abnormal feed condition-detecting apparatus according to a second embodiment.

The parts of FIG. 4 the same as those of the first embodiment are denoted by the same numerals. The output terminal of the first paper passage detector 44 is connected to one of the input terminal of the AND gate 50 through the inverter 48. A print instruction issued from the print instruction circuit 52 is conducted to the other input terminal of the AND gate 50. The output terminal of the AND gate 50 is connected to the set terminal S of the flip-flop circuit 54 and also to the conveyor belt control circuit 56. An output signal from the first paper passage detector 44 is delivered to the reset terminal R of the flip-flop circuit 54 and also to the print control circuit 58.

The set output terminal Q of the flip-flop circuit 54 is connected to one of the input terminals of the AND gate 74. The output terminal of the first paper passage detector 44 is connected to a first sheet rear edge detector 76. When supplied with a detection signal from the first paper passage detector 44, the sheet rear edge detector 76 diffentiates the detection signal, and issues a pulse signal denoting the passage of the rear edge of a sheet (hereinafter referred to as "a rear edge signal") when the sheet passages through the detector 76. The rear edge signal is supplied to the input terminal of a set signal generator 78 and also to the shift control terminals of the respective registers 82, 84, 86 connected in series to constitute a memory 80. When receiving a rear edge signal, the set signal generator 78 has its operation started after a delay of the prescribed length of time and then delivers a set signal having a logic level of "1" to the first stage register 82 of the memory 80.

The output terminal of the second paper passage detector 46 is connected through a second sheet rear edge detector 88 to a clear signal generator 90 and also to one of the input terminals of the AND gate 74. The second rear edge detector 88 is operated in the same manner as the first rear edge detector 76. The clear signal generator 90 is supplied with output signals from the respective registers 82, 84, 86. When receiving a rear edge signal from the second rear edge detector 88, the clear signal generator 90 has its operation started after a delay of the prescribed length of time and then clears the contents of any of the registers 82, 84, 86 which has a most significant "1" bit. In other words, if the register 86 has a logic level "1", the register 86 is cleared. Or if the register 86 has a logic level "0" and the register 84 has a logic level "1", the register 84 is cleared or if the registers 86, 84 has a "0" and the register 82 has a "1", the register 82 is cleared. An output signal from the register 82 is directly supplied to the AND gate 74, and output signals from the register 84, 86 are sent forth to the AND gate 74 through the corresponding inverters 92, 94. An output signal from the AND gate 74 is delivered to the abnormality control circuit 72.

There will now be described by reference to FIG. 4 the operation of an abnormal feed condition-detecting apparatus according to the second embodiment of this invention for a printing device which is constructed as mentioned above. Now let it be assumed that as in the first embodiment, the printing device continuously prints data on sheets. When the AND gate 50 receives a print instruction for a first copy sheet, the AND gate 50 is opened to set the flip-flop circuit 54, causing the conveyor belt control circuit 56 to be operated. At this time, the first rear edge detector 76 and the second paper passage detector 46 do not yet produce an output signal. Therefore, the AND gate 74 is not opened, nor is issued any abnormality signal.

Where a sheet is drawn out of the feeder 26 by the action of the feed roller 30, and the passage of the sheet is detected by the first paper passage detector 44, then the flip-flop circuit 54 is reset. When this flip-flop circuit 54 is reset, the AND gate 74 is closed, and an abnormality signal is not issued as in the preceding case. Where the first paper passage detector 44 generates a detection signal as in the first embodiment, then the print control circuit 58 is operated, thereby allowing for printing.

Where a sheet passes through the first paper passage detector 44 and the rear edge detector 76 sends forth a rear edge signal, then the contents of the register 84 are shifted to the register 86, and the contents of the register 82 are transferred to the register 84. A signal having a logic level of "1" produced from the set signal generator 78 is stored in the register 82. As a result, the printing device waits for the succeeding print instruction. If, in case a sheet is drawn out of the feeder 26, an immediately preceding sheet is still left in the printing device, then the contents of the register 82 have a logic level of "1". If a sheet taken out of the feeder 26 immediately ahead of the immediately preceding sheet is still retained in the printing device, the contents of the register 84 have a logic level of "1". Similarly, if a sheet drawn out of the feeder 26 immediately before the second-mentioned sheet is still travelling through the printing device, then the contents of the register 86 have a logic level of "1". Therefore, it is possible to judge the presence of a sheet in the printing device from the logic level of the contents of the registers 82, 84, 86. When a sheet whose printed data has been fixed is taken out through the outlet port 40, then a rear edge signal is supplied to the clear signal generator 90 to clear any of the registers 82, 84, 86 which has a most significant "1" bit. Thus, the withdrawal of a sheet from the printing device can be ascertained by the clearance of the contents of the corresponding register.

If an abnormal condition happens during the printing of sheets, a new sheet is not supplied to the printing device, and the flip-flop circuit 54 remains set. Therefore, all the sheets supplied to the printing device before the judgement of the occurrence of said abnormality are successively taken out of the printing device. As a result, the contents of the registers 86, 84 are cleared. When a sheet delivered from the feeder 26 immediately before the occurrence of the abnormality is drawn out of the printing device, then the rear edge detector 88 sends forth a rear edge detection signal. Since the contents of the register 82 are not cleared at this time, the logic levels of the contents of the registers 82, 84, 86 are respectively indicated by the binary codes of "1", "0", "0". An output signal from the AND gate 74 which is now opened is supplied to the abnormality control circuit 72 to inform the operator of the occurrence of an abnormal condition.

Where, with the above-mentioned second embodiment, too, an abnormal condition takes place in which a sheet is not properly delivered from the feeder due to, for example, jamming, then the printing device is stopped, only after all sheets supplied to the printing device before the judgement of the occurrence of the above-mentioned abnormal condition are drawn out of the printing device. Therefore, any of the sheets which are still traveling through the printing device before the occurrence of the abnormal condition is not taken out of the printing device with the printed data left unfixed. Therefore, the printed data is prevented from being wasted.

According to the second embodiment of FIG. 4, the memory 80 is chosen to include three registers 82, 84, 86, because three sheets are assumed to be travelling by the conveyor belt through the printing device at any given point of time. Obviously, the number of the registers can be adjusted according to the number of sheets which are designed to travel through the printing device during the prescribed period of time.

The foregoing description refers to the case where the abnormal feed condition-detecting apparatus of this invention was applied to an electronic printing device. However, this invention is not limited to the aforesaid embodiments, but is applicable to similar printing devices such as an electronic copying machine.

What we claim is:

1. An abnormal feed condition-detecting apparatus for a printing device comprising:

record instruction means for generating a record instruction signal;

paper feed means connected to said record instruction means to send out papers one by one according to said record instruction signal;

conveying means provided adjacent to said paper feed means and extending so as to convey the paper from said feed means to the outside of the printing device;

detecting means provided on one end of said conveying means which is near to said paper feed means to generate a detection signal according to the passage of the paper;

image forming means disposed adjacent to said conveying means to form an image on the paper being conveyed according to the detection signal of said detecting means;

count means connected to said record instruction means and detecting means to count a time from the generation of the record instruction signal to the generation of the detection signal;

reference signal generating means for generating a reference signal corresponding to a time required to deliver the paper from said paper feed means to the outside of the printing device; and an abnormal feed condition-detecting means connected to said count means and said reference signal generating means to generate an abnormal feed condition-detecting signal upon coincidence of the count output signal of said count means and said reference signal.

2. An apparatus according to claim 1, wherein: said count means comprises:

a pulse generator, a flip-flop adapted to be set by the output signal of said record instruction means and reset by said detection signal of said detecting means, an AND gate connected to receive output signals of said pulse generator and flip-flop, and an adder reset by said detection signal, said adder counting the output signals of said AND gate.

3. An abnormal feed condition-detecting apparatus for a printing device comprising:

record instruction means for generating a record instruction signal;

paper feed means connected to said record instruction means to send out papers one by one according to the record instruction signal;

conveying means provided adjacent to said paper feed means and extending so as to convey the paper from said feed means to the outside of the printing device;

first detecting means provided on one end of said conveying means which is near to said paper feed means to generate a first detection signal according to the passage of the paper;

image forming means disposed adjacent to said conveying means to form an image on a conveying paper according to the detection signal of said detecting means;

second detecting means provided on the other end of said conveying means which is near to the outside of the printing device to generate a second detection signal according to the passage of the paper;

means, connected to said first and second detecting means, for monitoring the number of papers on said conveying means according to the first and second detection signals and for generating a third detection signal when the number of conveying papers is decreased by one; and abnormal feed condition-detecting means connected to said record instruction means and monitoring means to generate an abnormal feed condition-detecting signal upon coincidence of said record instruction signal, said second detection signal and said third detection signal.

4. An apparatus according to claim 3, wherein:

said monitoring means comprises a shift register having flip-flops, the number of flip-flops being the same as the maximum number of papers capable of being concurrently present on said conveying means, the content of each of said flip-flops being shifted to the flip-flop of the next upper stage according to the first detection signal and thereafter the flip-flop of the lower stage being set in response to said first detecting means, the highest of said flip-flops which is set, being reset by the second detection signal, the third detection signal being formed by the output signal of the flip-flop of the lowest stage and inverted output signals of the other flip-flops; and said abnormal feed condition-detecting means comprises a flip-flop set by the record instruction signal and reset by the first detection signal and an AND gate connected to receive an output signal of the flip-flop and the second and third detection signals, an output signal of the AND gate acting as the abnormal feed condition-detecting signal.

* * * * *